United States Patent [19]

Lerro

[11] 4,078,660

[45] Mar. 14, 1978

[54] MEDICAL ALERT BRACELET

[76] Inventor: Kathleen M. Lerro, C-4 Bellevue Court Apts., Penndel, Pa. 19047

[21] Appl. No.: 658,291

[22] Filed: Feb. 17, 1976

[51] Int. Cl.[2] ..... B65D 85/56; A44C 5/00; G09F 3/14

[52] U.S. Cl. ..... 206/530; 40/21 C; 53/3; 206/469; 206/531; 206/532; 206/534; 224/28 B

[58] Field of Search ..... 206/38, 216, 461, 469, 206/471, 484, 486, 530, 531, 532, 534, 459; 40/21 C; 224/28 R, 28 B; 229/517 S; 128/222, 272

[56] References Cited

U.S. PATENT DOCUMENTS

| | | | |
|---|---|---|---|
| 1,806,142 | 5/1931 | Beck | 40/21 C |
| 2,473,226 | 6/1949 | Sheldon | 224/28 B |
| 3,009,614 | 11/1961 | Humphner | 224/28 B |
| 3,029,939 | 4/1962 | Feldman | 206/466 |
| 3,054,503 | 9/1962 | Hartman, Jr. et al. | 206/531 |
| 3,157,326 | 11/1964 | Murphy | 224/28 B |
| 3,402,808 | 9/1968 | Yannuzzi | 224/28 B |
| 3,467,246 | 9/1969 | Long et al. | 206/820 |
| 3,680,751 | 8/1972 | Tenbrook | 224/28 B |
| 3,764,351 | 10/1973 | Whittington et al. | 229/517 S X |
| 3,805,427 | 4/1974 | Epstein | 40/21 C |
| 3,924,304 | 12/1975 | Grandmont | 224/28 B |

*Primary Examiner*—Stephen Marcus
*Attorney, Agent, or Firm*—Smith, Harding, Earley & Follmer

[57] ABSTRACT

A medical alert bracelet for carrying an emergency supply of a patient's medicament comprising a bracelet strap and a blister package containing a medicament form. The blister package is held in the bracelet strap, a hole is formed in the bracelet strap beneath the blister package for push-through ejection of the medicament from the bracelet, and a closure is provided for closing the strap onto the wrist of the patient. A weakened line is positioned across the strap and is easily ruptured to remove the strap from the patient's wrist, and a locator notch is provided at the weakened line so that it is easily located, even in the dark. The invention also includes a method of making the medical alert bracelet.

5 Claims, 5 Drawing Figures

MEDICAL ALERT BRACELET

BACKGROUND OF THE INVENTION

This invention relates to a medical alert bracelet for carrying an emergency supply of a patient's medicament, and to a method of making the bracelet.

A patient who is suffering from an illness, such as diabetes or heart trouble, is often provided with a medicament which he is instructed to take when he is undergoing an attack. However, these attacks come without warning, and may occur when the medicament is not close at hand. Also, even though the medicament is close-by, the patient may be incapacitated by the attack and be unable to reach the medicament and administer it to himself.

Patients suffering from certain illnesses are provided with bracelets with indicia thereon that identifies the illness and gives instructions as to the proper procedure to follow if the patient should be stricken with an attack. Ambulance and medical personnel are trained to look for such bracelets and to follow the instructions thereon. However, there are times when the ambulance personnel are unable to administer the necessary medicament because they cannot find it. The medicament may not be on the person of the patient, and he may not be in a condition to speak and tell where the medicament is located.

Another problem in the prior art has been that, even if the medicament is located, it may be in a container which is difficult to open, especially if it must be made child-proof, and may be almost impossible to open and administer to the patient in the dark.

SUMMARY OF THE INVENTION

It is an object of this invention to overcome the problems of the prior art by providing an emergency supply of a medicament which is always on the person of the patient, and is easily removed and administered to the patient under the most adverse circumstances, such as in the dark, or while swimming.

The invention comprises a medical alert bracelet which may be attached to the wrist of the patient and worn at all times. The medicament is hermetically sealed, and the bracelet is provided with an easy-open weakened transverse line which is located easily, even in the dark, because it is marked by a locator notch. The medicament is contained or incapsulated in a blister package having a rupturable metal foil bottom sheet positioned over a hole in the bracelet strap.

In an emergency, the medicament is always on the person of the patient, and he may locate the weakened line by means of the locator notch, tear the strap along the weakened line, place the strap in proximity to his mouth, and eject the medicament into his mouth by pushing against the blister button or cup to eject the medicament form through the metal foil bottom sheet directly into his mouth. These simple steps can be performed anywhere, even in the dark, and even under water.

DETAILED DESCRIPTION OF THE INVENTION

Figure 1:
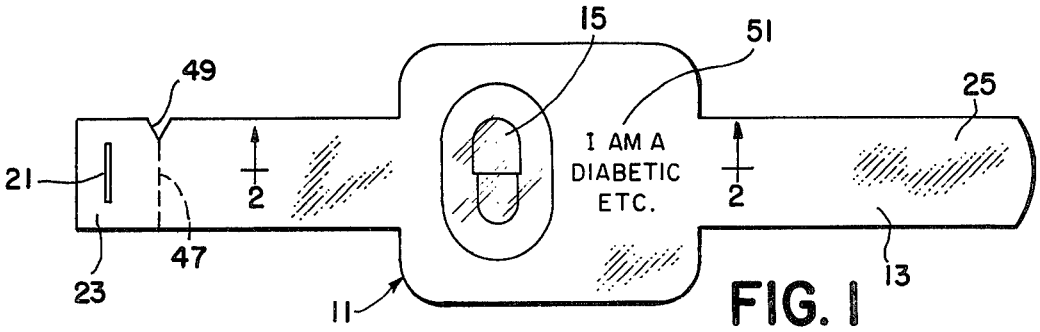
FIG. 1 is a view in top plan of medical alert bracelet constructed in accordance with the invention.
Figure 2:
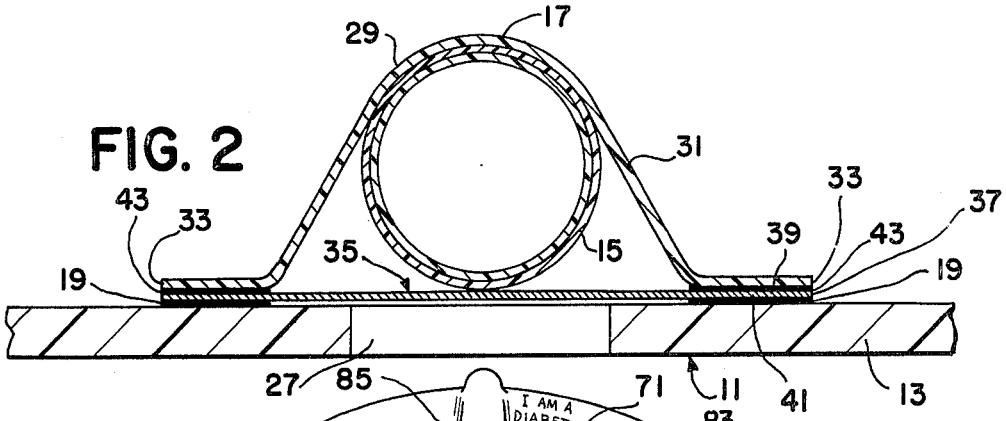
FIG. 2 is a view in section, on an enlarged scale, taken as indicated by the lines and arrows 2—2 which appear in FIG. 1.

Turning now to the embodiments of the invention selected for illustration in the drawings, there is shown, in FIGS. 1 and 2, a disposable medical alert bracelet 11 suitable for one-time use. Bracelet 11 is adapted for carrying an emergency supply of a patient's medicament, and comprises a bracelet strap 13, a medicament form 15 which may be of any type such as a tablet or capsule but which is here illustrated as a capsule 15, a blister package 17 containing the medicament form 15, means such as heat seal 19 for holding the blister package 17 to the bracelet strap 13, and closure means such as stainless steel staple 21 for affixing the strap ends 23, 25 together onto the wrist of a patient.

A hole 27 is formed in the bracelet strap 13 beneath the blister package 17 and the capsule 15 for push-through ejection of the capsule 15 from the bracelet 11.

Blister package 17 includes a transparent top blister sheet 29 having an inverted cup portion 31 surrounded by a flat margin 33.

Blister package 17 also includes a rupturable bottom sheet 35 which includes an aluminum foil sheet 37 covered by an upper layer 39 of clear plastic and a lower layer 41 of clear plastic. Upper layer 39 is connected to blister margin 33 by a heat seal 43, and lower layer 41 is connected to the top surface of strap 13 by heat seal 19.

Medical alert bracelet 11 is provided with rupture means such as a weakened transverse line 47 which has been perforated, as shown, or creased.

The bracelet 11 is provided with locator means at the rupture means for easily locating the rupture means, even in the dark, and the locator means comprises a notch 49 formed in the edge of the strap 13 at the end of perforated line 47.

Bracelet strap 13 comprises a single sheet of a flexible synthetic plastic such as PVC (polyvinyl chloride) or ACLAR vinyl which is a laminate sold under the trademark ACLAR by Tenneco. Strap 13 is preferrably about 5 mils in thickness for easy tearing, and, in general, may be made of any flexible synthetic plastic. Upper layer 39 and lower layer 41 of bottom blister sheet 35 may be made of PVC or of any other flexible synthetic plastic that is capable of being heat sealed to the bracelet strap 13 and to the top blister sheet 29.

The method of packaging a medicinal form 15 into an emergency medical alert bracelet 11 which may be attached to the patient's wrist where it is always available, comprises the steps of forming a bracelet strap 13 of flexible material, forming a hole 27 in the bracelet strap, and attaching a blister package 17 containing a medicament form 15 to the bracelet strap 13 so that the medicament form 15 registers with the strap hole 27 for push-through ejection of the medicament from the bracelet.

The method also includes the steps of forming rupture means for easily removing the strap 13 from the patient's wrist by weakening a line 47 across the strap 13 by perforating it or by creasing it, forming locator means for easily locating the rupture means by making a notch 49 in the edge of the strap 13 at line 47, and applying instruction indicia 51 to the strap 13. Accordingly, a person may read the instruction indicia 51, locate the rupture means 47, rupture the bracelet strap 13, and eject the medicament form 15 from the bracelet 11 into the mouth of the patient.

In use, the doctor treating the patient may affix the medical alert bracelet 11 to the patient's wrist by applying the stainless steel staple 21 which attaches strap ends 23, 25 together onto the patient's wrist. So affixed, the bracelet 11 remains always on the person of the patient, and may be worn at all times, even while swimming. In case of an attack of his illness, the patient may locate the notch 49 and rip the transverse line 47 to remove the bracelet 11 from his wrist. He then brings the hole 27 to his mouth, and pushes on the cup portion 31 of blister package 17 to eject the capsule 15 from the blister package cavity into his mouth.

In case the patient is unable to move, medical or ambulance personnel can read the instruction indicia 51, locate and rip weakened line 47 to remove the bracelet 11 from the patient's wrist, place the bracelet 11 against the patient's lips and push on the cup portion 31 of the blister package 17 to eject the capsule 15 into the patient's mouth.

Figure 3:
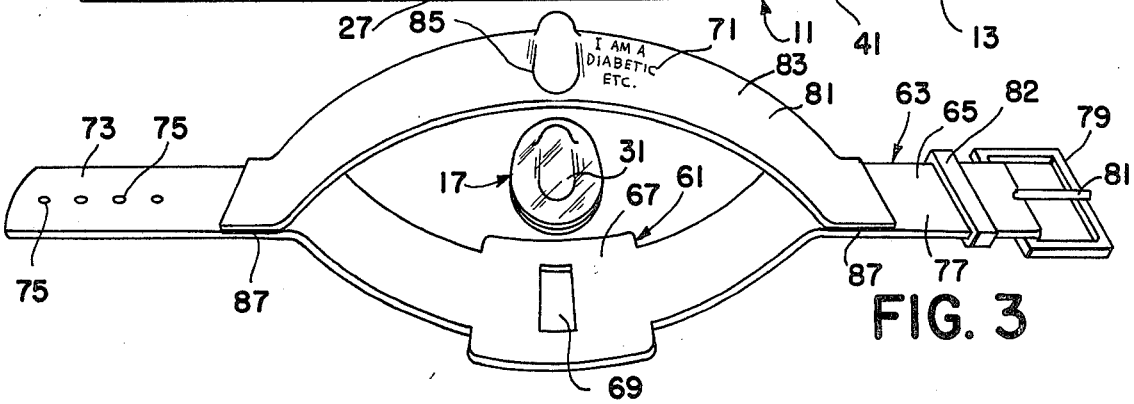
FIG. 3 is a view of an alternative embodiment of the invention in which the bracelet strap is reuseable.
Figure 4:
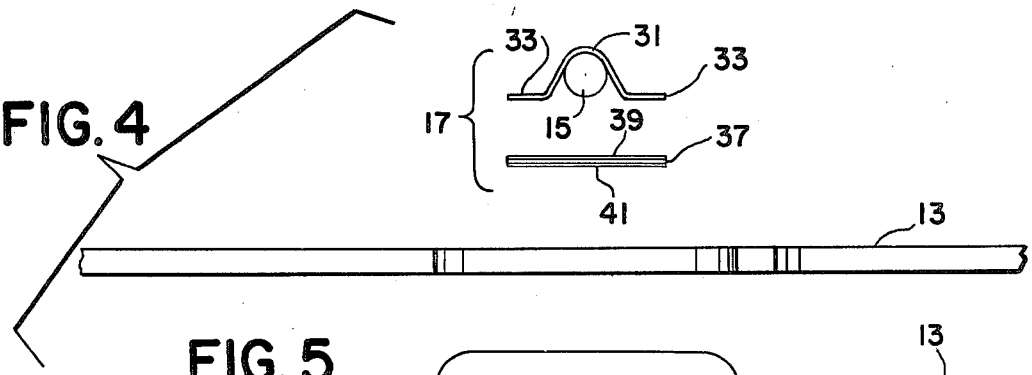
FIG. 4 is an exploded view of a bracelet similar to the bracelet of FIGS. 1 and 2.
Figure 5:
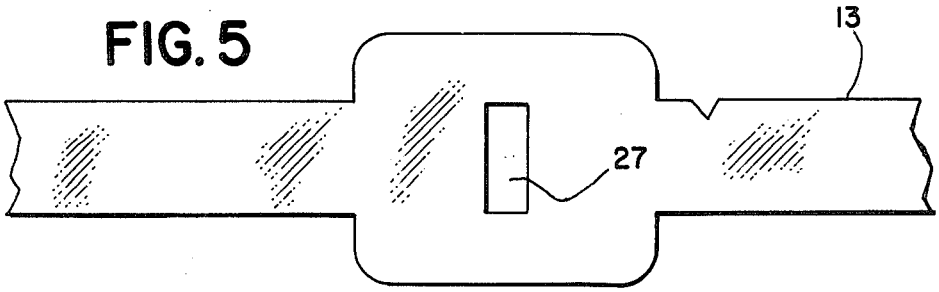
FIG. 5 is a bottom plan view of the bracelet of FIG. 4.

Turning now to the alternative embodiment of the invention shown in FIG. 3, there is shown a reuseable medical alert bracelet 61 which comprises a bracelet strap 63, a bottom sheet 65 with a transversely expanded center portion 67 having a hole 69 formed therein and having instructional indicia 71 imprinted thereon. One end 73 of strap bottom sheet 65 is provided with a series of strap holes 75 and the other end 72 of bottom sheet is provided with a buckle 79 having a tongue 81 adapted to fit into any one of the holes 75 to attach the reuseable medical alert bracelet 61 to the wrist of the patient.

A top sheet 83 of flexible material is connected at its ends to bottom sheet 65 and includes an inverted cup portion 85 which is adapted to fit over a blister package 17. The ends of top sheet 83 may be connected to bottom sheet 65 by a seal 87 which may be a heat seal or an adhesive seal.

The method of packaging a medicinal form 15 into an emergency medical alert bracelet 61 of the reuseable type, which may be attached to a patient's wrist where it is always available, includes forming a bracelet strap 63 of flexible material, with strap 63 having a bottom sheet 65 with a transversely expanded center portion 67 having hole 69 formed therein and instructional indicia 71 imprinted thereon, providing end 73 of strap 65 with a series of strap holes 75, providing the other end 77 of the bracelet strap 63 with a buckle 79 having a tongue 81 and retainer loop 82, and connecting a top sheet 83 to bottom sheet 65. Top sheet 83 is made of flexible material and has an inverted cup portion 85 adapted to fit over a medicament form 15. Top sheet 83 may be connected to the ends of bottom sheet 65 by adhesive or heat seals 87.

In use, the sheets 65 and 83 are separated by pushing the ends 73 and 77 of strap 63 towards each other, and the inverted cup portion 31 of blister package 17 is inserted into the inverted cup portion 85 of bracelet top sheet 83. The capsule 15 and rupturable bottom sheet 35 are positioned over hole 69. The blister package 17 is secured between strap sheet 65 and 83 by pulling the ends 73 and 77 of the bracelet strap 63 away from each other to bring the bottom and top sheet 65 and 83 into close contact. Then the bracelet 61 is placed around the wrist of the patient and is secured thereto by inserting end 73 through buckle 79 with tongue 81 in an appropriate hole 75 and end 73 under retainer loop 82.

When the patient wants to take the medicament 15 in the reuseable medical alert bracelet 61, he unbuckles bracelet 61, removes it from his wrist, places the bracelet hole 69 against his mouth, and injects the capsule 15 into his mouth by pushing his finger against inverted cup portion 85 to push medicament 15 through and rupture the bottom sheet 35 of the blister pack.

If the patient is unable to perform these actions because of some incapability, medical or ambulance personnel may read the instructon indicia 71 and perform this task for the patient.

When the medicament 15 in blister package 17 has been ejected from the package, the empty blister package 17 may be removed and a new one inserted into inverted cup 85 above ejection hole 69 so that medical alert bracelet 61 may be reused.

With the medical alert bracelets of the present invention, the patient can take his medication under the most difficult of conditions, even under water, and in complete darkness.

I claim:

1. A medical alert bracelet for carrying an emergency supply of a patient's medicament comprising
- a bracelet strap,
- a medicament form,
- a blister package containing the medicament form,
- means for holding the blister package to the bracelet strap,
- closure means for affixing the strap ends together onto the wrist of a patient,
- said strap comprising a bottom sheet of flexible material,
- a top sheet of flexible material having an inverted cup portion which fits over said blister,
- and means connecting the ends of the top and bottom sheets together.

2. A medical alert bracelet for carrying an emergency supply of a patient's medicament comprising
- a bracelet strap,
- a medicament form,
- a blister package containing the medicament form,
- means holding the blister package to the bracelet strap,
- closure means for affixing the strap ends together onto the wrist of a patient,
- including a hole formed in the bracelet strap beneath the blister package for push-through ejection of the medicament form from the bracelet, said blister package including
- a transparent blister sheet having an inverted cup portion surrounded by a flat margin,
- and a bottom rupturable sheet,
- said flat margin of the blister sheet being heat sealed to the bottom sheet,
- said bottom rupturable sheet overlying said hole in the strap,
- bracelet rupture means on the strap for easily removing the strap from the patient's wrist to take the medicament,
- said bracelet rupture means comprising a perforated line across the strap,
- locator means at the rupture means for easily locating the rupture means even in the dark,
- said locator means comprising a notch in the edge of the strap, and said strap comprising a single sheet of flexible transparent synthetic plastic.

3. A medical alert bracelet for carrying an emergency supply of a patient's medicament comprising a bracelet strap, a medicament form, a blister package containing the medicament form, means holding the blister package to the bracelet strap, closure means for affixing the strap ends together onto the wrist of a patient, a hole formed in the bracelet strap beneath the blister package for push-through ejection of the medicament form from the bracelet, said blister package including a transparent top blister sheet having an inverted cup portion surrounded by a flat margin, a bottom rupturable sheet, a heat seal which seals the flat margin of the blister sheet to the bottom sheet, said bottom rupturable sheet overlying said strap hole, bracelet rupture means on the bracelet strap for easily removing the strap from the patient's wrist for push-through ejection of the medicament form from the bracelet, said bracelet rupture means comprising a perforated line across the strap, locator means at the bracelet rupture means for easily locating the bracelet rupture means even in the dark, said locator means comprising a notch in the edge of the strap.

4. A method of packaging a medicinal form into an emergency medical alert bracelet which may be attached to a patient's wrist where it is always available, comprising forming a bracelet strap of flexible material, forming a hole in the bracelet strap, attaching a blister package with a rupturable bottom sheet and containing a medicament form to the bracelet strap so that the medicament form registers with the strap hold for push-through ejection of the medicament from the bracelet, including forming a top sheet of flexible material having an inverted cup portion which fits over said blister package, forming a bottom sheet of flexible material, and connecting the ends of the top and bottom sheets together to form a bracelet strap.

5. A method of packaging a medicinal form into an emergency medical alert bracelet which may be attached to a patient's wrist where it is always available, comprising forming a bracelet strap of flexible material, forming a hole in the bracelet strap, attaching a blister package with a rupturable bottom sheet and containing a medicament form to the bracelet strap so that the medicament form registers with the strap hole for push-through ejection of the medicament from the bracelet, forming bracelet rupture means for easily removing the strap from the patient's wrist by weakening a line across the strap, forming locator means for easily locating the bracelet rupture means by making a notch in the edge of the strap at said weakened line, applying instruction indicia to the strap so that a person may read the instruction indicia, locate the rupture means, rupture the bracelet, and eject the medicament form from the bracelet by push-through ejection of the medicament form through the strap hole.

* * * * *